United States Patent [19]

Ribellino, Jr.

[11] Patent Number: 4,828,104

[45] Date of Patent: May 9, 1989

[54] PERSONALIZED MAILING ENVELOPE OR CARRIER AND METHOD OF ENCLOSING A PERSONALIZED LETTER IN A PERSONALIZED MAILING ENVELOPE OR CARRIER

[76] Inventor: James V. Ribellino, Jr., 208 Bay Ter., Staten Island, N.Y. 10306

[21] Appl. No.: 279,462

[22] Filed: Dec. 2, 1988

Related U.S. Application Data

[63] Continuation of Ser. No. 13,607, Feb. 12, 1987.

[51] Int. Cl.[4] ..... B65D 65/12

[52] U.S. Cl. ..... 229/71; 53/428; 53/460; 206/459; 209/584; 209/900; 229/73; 283/94

[58] Field of Search ..... 53/209, 266, 428, 450, 53/452, 460; 206/459, 632; 209/569, 584, 900; 229/68 R, 70, 71, 73, 92.1; 283/94, 101, 103

[56] References Cited

U.S. PATENT DOCUMENTS

| | | | |
|---|---|---|---|
| 883,620 | 3/1908 | Carraway | 283/103 |
| 2,889,941 | 6/1959 | Mehlis | 209/584 |
| 3,126,211 | 3/1964 | Hieken et al. | 206/632 |
| 3,195,802 | 7/1965 | Jacobs | 229/71 |
| 3,315,805 | 4/1967 | Brenner et al. | 209/900 |
| 3,365,117 | 1/1968 | Powell, Jr. | 229/71 |
| 3,522,908 | 8/1970 | Carrigan | 229/71 |
| 3,531,628 | 9/1970 | White, Jr. | 229/71 |
| 3,652,830 | 3/1972 | Kessler | 229/68 R |
| 3,656,684 | 4/1972 | Meehan | 53/460 |
| 3,830,422 | 8/1974 | Dunn | 229/71 |
| 3,895,220 | 7/1975 | Nelson et al. | 209/569 |
| 4,245,775 | 1/1981 | Conn | 229/71 |
| 4,299,073 | 11/1981 | Golicz et al. | 53/209 |
| 4,317,030 | 2/1982 | Berghell | 229/68 R |
| 4,454,980 | 6/1984 | Poehler | 229/73 |
| 4,461,661 | 6/1984 | Fabel | 229/73 |
| 4,598,860 | 7/1986 | Pennock | 229/71 |

FOREIGN PATENT DOCUMENTS

| | | | |
|---|---|---|---|
| 0703629 | 2/1965 | Canada | 229/71 |
| 2457040 | 6/1976 | Fed. Rep. of Germany | 229/71 |
| 2250581 | 6/1975 | France | 209/900 |
| 2322672 | 4/1977 | France | 209/900 |

*Primary Examiner*—Jimmy G. Foster

*Attorney, Agent, or Firm*—Sprung Horn Kramer & Woods

[57] ABSTRACT

The present invention relates to a personalized envelope in which is enclosed a personalized letter and a method of enclosing a personalized letter in a personalized mailing envelope. The personalized envelope has a small die-cut in an inconspicuous location through which a number on the enclosed personalized letter can be seen. By matching the number showing in the die-cut to a matching number on the envelope itself it is assured that the enclosed personalized letter is being sent to the correct addressee without reading name on letter.

4 Claims, 1 Drawing Sheet

PERSONALIZED MAILING ENVELOPE OR CARRIER AND METHOD OF ENCLOSING A PERSONALIZED LETTER IN A PERSONALIZED MAILING ENVELOPE OR CARRIER

This is a continuation of application Ser. No. 013,607, filed 2/12/87, now pending.

The present invention relates to a personalized mailing envelope in which is enclosed a personalized letter and a method of enclosing a personalized letter in a personalized mailing envelope. The personalized envelope has a small die-cut in an inconspicuous location through which a number on the enclosed personalized letter can be seen. By matching the number showing in the die-cut to a matching number on the envelope itself it is assured that the enclosed personalized letter is being sent to the correct addressee without reading name on letter.

BACKGROUND OF THE INVENTION

When letters are sent out by the direct response advertising industry and also in letters mailed as a selling/promotion tool, it is quite desirable to specifically name the recipient of the correspondence. Such personalized correspondence receives a better response from the receiver of such mail as compared to the response obtained from a non-personalized mass mailing.

The problem which arises in sending personalized letters in personalized envelopes is to be certain that the letter and envelope match exactly with respect to the addressee and his/her address. Normally, this matching operation is done by hand using costly human labor to read each name and hand enclose. By assigning unique identifying numbers to each addressee and using this to control match, a machine operator can control accuracy.

SUMMARY OF THE INVENTION

The object of the present invention is to devise a system to construct a carrier or envelope for a personalized letter wherein the need for hand processing of such correspondence is eliminated.

A further object of the invention is a method wherein a personalized letter can be inserted into a personalized envelope or carrier with exacting matching of letter with envelope or carrier without the need for reading the name of the addressee on the letter.

A further object of the invention is to allow automatic matching addressee on a personalized letter and the addressee and address on the carrier or envelope for the letter.

In accordance with the present invention an envelope or carrier for personalized correspondence to be included within is provided with a small die-cut in an inconspicuous place on the envelope or carrier so that a number carried on the personalized correspondence can be seen and matched with a number on the envelope or carrier. When the numbers are identical, it is assured that the correct piece of correspondence has been placed into the envelope or carrier.

The method of the present invention comprises (1) assigning unique identifying numbers to the addressees to which a personalized mailing is to be sent; (2) providing an envelope or carrier having a die-cut in a portion thereof; (3) placing the assigned unique identifying number of each addressee on the corresponding personalized letter in a portion of the letter wherein the assigned unique identifying number may be seen through the die-cut in the envelope or carrier after insertion of the letter into the envelope or carrier; (4) placing the assigned unique identifying number of each addressee on the corresponding envelope or carrier; (5) inserting the personalized letters into the envelope or carrier; (6) comparing the number on the inserted letter appearing in the die-cut of the envelope or carrier with the number on the envelope or carrier; and (7) determining if the number appearing in the envelope or carrier die-cut corresponds exactly to the number carried on the envelope or carrier. The determination of proper insertion can be carried out usually by a machine operator or automatically by a scanning device.

These objects and advantages of the present invention will become more apparent from a consideration of the following detailed description taken in conjunction with the accompanying drawings. While the specific embodiment shown in the figures is an envelope, it will be quite evident to those skilled in this art area that various types of carriers for correspondence can also be used.

DETAILED DESCRIPTION OF THE INVENTION

Figure 1:
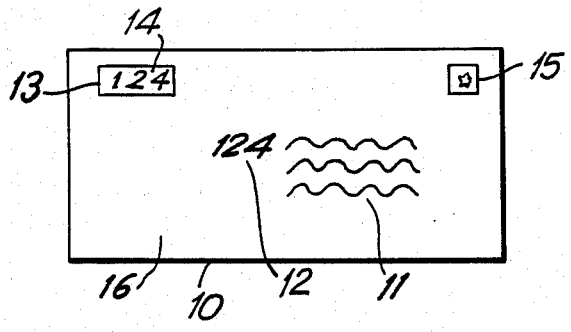
FIG. 1 is a plan view of an envelope having a die-cut in a portion thereof.

Referring now to FIG. 1, envelope 10 has a front face 16 which carries an address 11 and an identifying coding sequence number 12. In the left-hand corner of the envelope is a small die-cut 13 through which can be see another identifying coding sequence number 14 which is carried by correspondence within the envelope. A stamp 15 is placed in the upper right-hand corner of envelope 10.

It can be seen that when the number 14 carried on the correspondence which appears in die-cut 13 identically matches the identifying coding sequence number 12 on the envelope itself, there is assurance that the proper correspondence has been placed into the envelope.

It will be appreciated that inspection of the envelopes to determine if the identifying match can be done on an individual basis by a machine operator or can be done mechanically by a scanning device.

Figure 2:
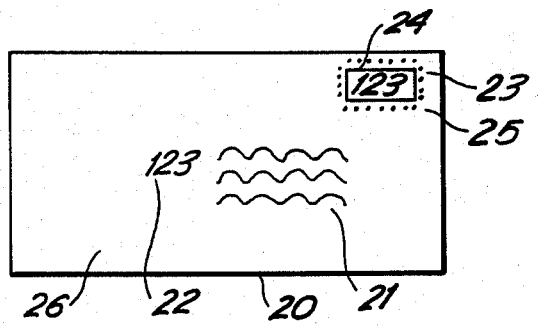
FIG. 2 is a plan view of a preferred embodiment wherein an envelope has a die-cut in the portion of the envelope which can later be covered by a stamp or postage label.

Referring now to FIG. 2, envelope 20 has a front face 26 which carries an address 21 and an identifying coding sequence number 22. A die-cut 23 is contained in the upper right hand corner of the envelope 10 through which can be seen an identifying coding sequence number 24 which is carried on correspondence which has been place into envelope 10. In dotted lines is shown a stamp or postage label 25 which is placed over die-cut 23 after the identifying numbers on the envelope 22 and correspondence 25 have been matched. When the stamp or postage label is so-placed the die-cut is concealed.

Figure 3:
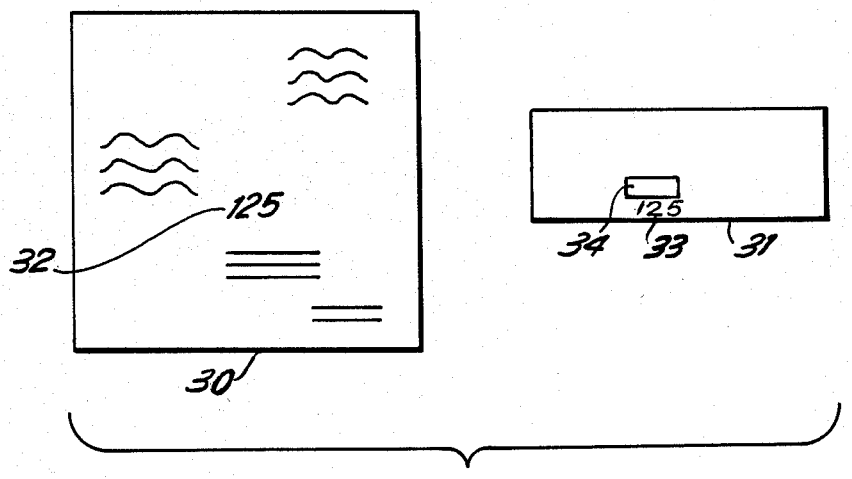
FIG. 3 is a plan view showing a personalized letter and an envelope having a die-cut in a portion thereof.

Referring now to FIG. 3, letter 30 carries on its face a unique identifying number. Envelope or carrier 31 has a die-cut 34 and a unique identifying number 33 corresponding to the identifying number on letter 30. The location of the identifying number 32 on the letter 30 is such that it can be seen through die-cut 34 on envelope or carrier 31 when the letter 30 is inserted into envelope or carrier 31.

By use of the envelope or carrier and method of the present invention, it has been quite surprisingly found that a personalized letter (form of correspondence) can be enclosed into a personalized envelope using presently available automated inserting equipment. The need (and cost) of using human labor to read each name and hand enclose the letter or correspondence into its proper envelope is eliminated. When the letter or correspondence and envelope or carrier are prepared, an identifying coded sequence number is placed on each. After placing the letter or correspondence into the envelope or carrier, the determination of whether the proper insertion has occurred can be easily and quickly accomplished.

By using a small die-cut on the envelope in an inconspicuous location, the number on the enclosed letter shows through the die-cut window below which is corresponding number so that the operator of the inserting equipment can maintain a perfect match control simply by looking at the face of the envelope. The operation could also be operated by using an automatic scanning device to check for matching numbers rather than the visual observation by an operator.

It will be appreciated that the instant specification and claims are set forth by way of illustration and not limitation, and that various modifications and changes may be made without departing from the spirit and scope of the present invention.

What is claimed is:

1. Personalized correspondence comprising a personalized envelope or carrier and correspondence wherein said envelope or carrier has on its front face a code wherein said code identifies the recipient of the envelope or carrier and a die-cut, said correspondence carrying a code on a portion thereof such that the code can be seen in the die-cut of the envelope or carrier in which the correspondence is inserted, wherein said code identifies the recipient of the correspondence and wherein the code carried on the envelope or carrier matches the code on the correspondence appearing in the die-cut of the envelope or carrier ensuring that the correspondence has been correctly inserted in the envelope or carrier said die-cut being in a position such that it can be covered by a stamp or postage label after the codes on the correspondence and envelope or carrier have been determined to be matching and wherein the die-cut has been covered by a stamp or postage label.

2. A method for assembling and inspecting personalized correspondence for different recipients comprising:

(1) preparing a plurality of personalized correspondence, each addressed to a different one of said recipients;

(2) assigning a code to each recipient wherein ech code uniquely identifies a recipient;

(2*a*) providing a plurality of envelopes or carriers, each having a die-cut window in a front face thereof, and each having on a front face thereof a destination address wherein the destination address on each envelope is different than the ones on the other envelopes or carriers;

(3) placing one of said codes onto each envelope or carrier wherein the resultant envelope or carrier codes are different from each other;

(4) placing on each of said correspondence one of said codes wherein the resultant correspondence codes are different from each other but wherein each correspondence code matches one of said envelope or carrier codes;

(5) placing said correspondence codes at a location on said correspondence wherein each correspondence code is able to show through the die-cut window in a respective one of said envelopes or carriers;

(6) inserting each correspondence into a respective envelope or carrier with the use of automated inserting equipment, wherein each correspondence code of said inserted correspondence matches the envelope or carrier code of said respective envelope or carrier, and wherein each correspondence code shows through the die-cut window of said respective envelope or carrier;

(7) inspecting each correspondence code through the window of the respective envelope or carrier and comparing to the envelope or carrier code of its respective envelope or carrier for determining if there is a match therebetween.

3. A method according to claim 2, wherein the inspecting and comparing of the code is performed by visual observation by a machine operator.

4. A method according to claim 2, wherein the inspecting and comparing of the code is performed by an automatic scanning device.

* * * * *